US007006001B2

(12) United States Patent
Estrada et al.

(10) Patent No.: US 7,006,001 B2
(45) Date of Patent: Feb. 28, 2006

(54) SPEECH-EMITTING CELEBRATION DEVICE

(76) Inventors: Mark A. Estrada, 7524 Mazatlan Dr., El Paso, TX (US) 79915; Robert A. Sherwood, 1155 Larry Mahan Ste., C, El Paso, TX (US) 79925; Roy A. Griffin, III, 1155 Larry Mahan Ste. C, El Paso, TX (US) 79925

( * ) Notice: Subject to any disclaimer, the term of this patent is extended or adjusted under 35 U.S.C. 154(b) by 0 days.

(21) Appl. No.: 10/160,929

(22) Filed: Jun. 4, 2002

(65) Prior Publication Data

US 2003/0222404 A1 Dec. 4, 2003

(51) Int. Cl.
*G08B 25/08* (2006.01)

(52) U.S. Cl. ..... 340/692; 340/654; 340/683; 340/384.3; 340/384.7; 446/397; 446/169; 446/404; 446/409

(58) Field of Classification Search ..... 340/692, 340/654, 683, 384.3, 384.7; 446/169, 404, 446/409, 397
See application file for complete search history.

(56) References Cited

U.S. PATENT DOCUMENTS

| | | | | |
|---|---|---|---|---|
| 5,375,839 | A * | 12/1994 | Pagani | 473/570 |
| 5,476,407 | A * | 12/1995 | Hall, Jr. | 446/397 |
| 5,482,277 | A * | 1/1996 | Young | 273/161 |
| 5,895,308 | A * | 4/1999 | Spector | 446/397 |
| 6,009,752 | A * | 1/2000 | Iwata | 73/514.09 |
| 6,273,421 | B1 * | 8/2001 | Thalheimer et al. | 273/161 |
| 6,368,176 | B1 * | 4/2002 | Lozowski et al. | 446/397 |
| 6,567,782 | B1 * | 5/2003 | Wakimura | 704/500 |

* cited by examiner

*Primary Examiner*—Daniel Wu
*Assistant Examiner*—Tai T. Nguyen
(74) *Attorney, Agent, or Firm*—M. K. Silverman

(57) ABSTRACT

A speech or phrase emitting celebration device, in the nature of a piñata, includes a longitudinal axial channel within which is placed a complementally sized integrated circuit ("IC") including a library of pre-programmed voice chips having phrases selected by random. The circuit is responsive to impacts or shocks upon a fanciful housing of the device sufficient to actuate a shock sensor switch thereof. A speaker, in electrical communication with the circuit board of the integrated circuit, is in mechanical communication with a speaker at an end of the channel so that the emitted phrase may be heard by those in the vicinity of the device. A hollow cylindrical sensor may be disposed within the interior channel to provide appropriate input to the shock sensor switch, or a more sensitive discrete element sensor may be used.

15 Claims, 5 Drawing Sheets

SPEECH-EMITTING CELEBRATION DEVICE

BACKGROUND OF THE INVENTION

A. Area of Invention

The invention relates to a Hispanic celebration device which annunciates one or more different messages upon impact to the device.

B. Prior Art

Toys are known that incorporate voice chips which, when activated, broadcast selected noises or messages during movement or play with the toy to thereby render such a toy more versatile and attractive to play with. The invention more particularly relates to a substantially solid cylindrical or character-shaped celebration device known as a piñata which, in the course of celebration, is typically impacted by a stick or a human foot to trigger one of a set of randomly different messages appropriate to the occasion being celebrated, and is generally intended as a single use device. An example of the prior art is reflected in U.S. Pat. No. 5,375,839 (1994) to Pagani, entitled Impact Sensitive Talking Ball, this teaching a device which responds to vibration of a type which can be imparted by the hand or arm of a child, this as opposed to a toy responsive to impact by a stick or other such acute application force that would pierce or break the housing of the device.

Piñatas, as such, have been subject to various U.S. patents as is reflected in U.S. Pat. No. 3,983,658 (1976); U.S. Pat. No. 4,167,078 (1979); U.S. Pat. No. 4,186,514 (1980); U.S. Pat. No. 4,253,266 (1981); U.S. Pat. No. 4,787,872 (1988); U.S. Pat. No. 5,263,889 (1993); U.S. Pat. No. 5,242,308 (1993) U.S. Pat. No. 5,562,518 (1996); U.S. Pat. No. 5,824,378 (1998); U.S. Pat. No. 6,059,708 (2000); and U.S. Pat. No. 6,171,166 (2001). None of these devices exhibit a talking or annunciation capability.

In Hispanic culture the "breaking of the piñata" is an important aspect of many celebrations. However, if the piñata is "broken," it follows that the piñata cannot be re-used. However, due to economic and practical considerations involving the number of piñatas employed on particular occasions and their costs, one may wish to use a more elaborate or aesthetic device that is re-usable or a device having a re-usable element such as a voice chip. Nonetheless, the problem remains of developing a piñata which is sufficiently responsive to impact such that it appears to be "broken" in something approaching the traditional sense. The instant invention addresses this problem by providing annunciation means to a piñata so that, if impacted with sufficient force, a shock switch will trigger a voice chip circuit which broadcasts a message. Thereby, an incentive will exist to strike the piñata, typically with a stick, with sufficient impact to cause the broadcast of an occasion-specific message or one of a randomly mixed set of occasion-specific messages upon sufficient impact or shock to the piñata.

The instant invention thereby addresses a long felt need in the art for a "talking" piñata having an optionally re-usable voice chip element, and which satisfies cultural needs associated with the ceremonial use thereof to "break the piñata."

SUMMARY OF THE INVENTION

A speech or phrase emitting celebration device, in the nature of a piñata, includes a longitudinal axial channel within which is placed a complementally sized integrated circuit ("IC") including a library of pre-programmed voice chips having phrases selected at random. Said circuit is responsive to impacts or shocks upon a fanciful housing of the device sufficient to actuate a shock sensor switch thereof. A speaker, in electrical communication with the circuit board of the integrated circuit, is in mechanical communication with a speaker at an end of said channel so that the emitted phrase may be heard by those in the vicinity of the device. A hollow cylindrical sensor may be disposed within said interior channel to provide appropriate input to the shock sensor switch, or a more sensitive discrete element sensor may be used.

It is accordingly an object of the invention to provide a ceremonial device in the nature of a piñata which will annunciate one of a set of pre-programmed phrases, responsive to sufficient impact upon the housing thereof.

It is another object to provide an impact sensitive ceremonial device.

It is a further object of the invention to provide a talking toy of a type that will broadcast only when impacted by a stick, or other means, with sufficient force.

It is another object to provide a piñata having a re-usable voice chip IC circuit.

It is yet another object of the invention to provide a piñata having a recording feature.

It is another object to provide a piñata that evokes responses based upon the magnitude of shock applied to the piñata.

It is a further object of the invention to provide a piñata that opens to dispense a product when the piñata is struck.

It is a yet further object to control the output of light from the piñata in response to striking of a piñata.

It is still another object of the invention to provide a piñata having a programming feature.

It is a yet further object to prevent unauthorized programming or reprogramming of a piñata.

The above and yet other objects and advantages of the invention will become apparent for the hereinafter set forth Brief Description of the Drawings and Detailed Description of the Invention.

DETAILED DESCRIPTION OF THE INVENTION

Figure 1:
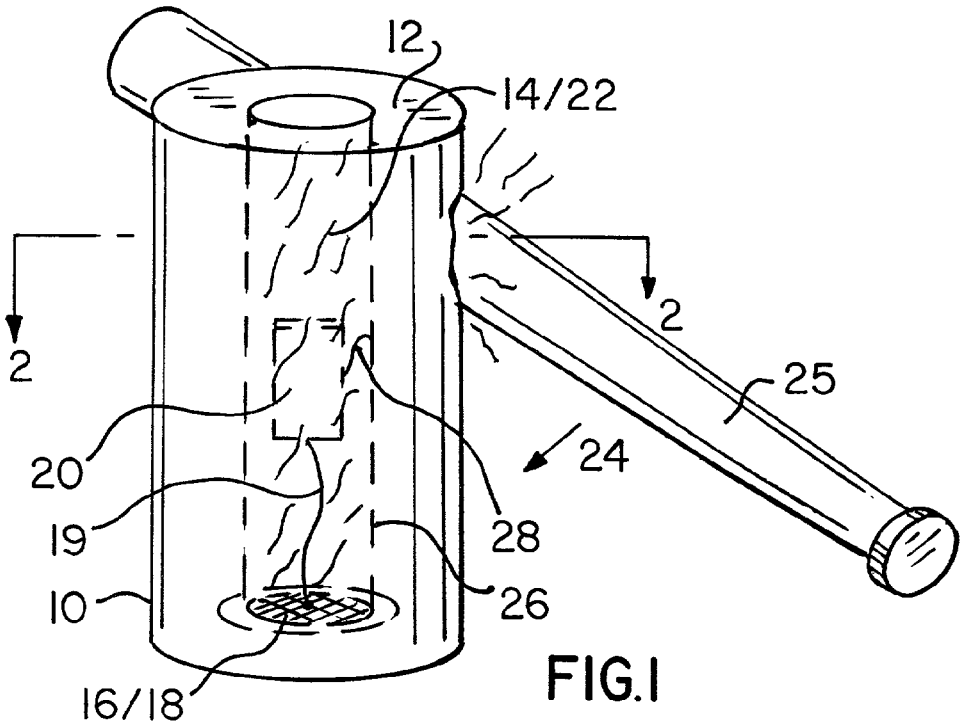
FIG. 1 is a perspective schematic view of the inventive piñata being impacted by a bat or stick.
Figure 2:
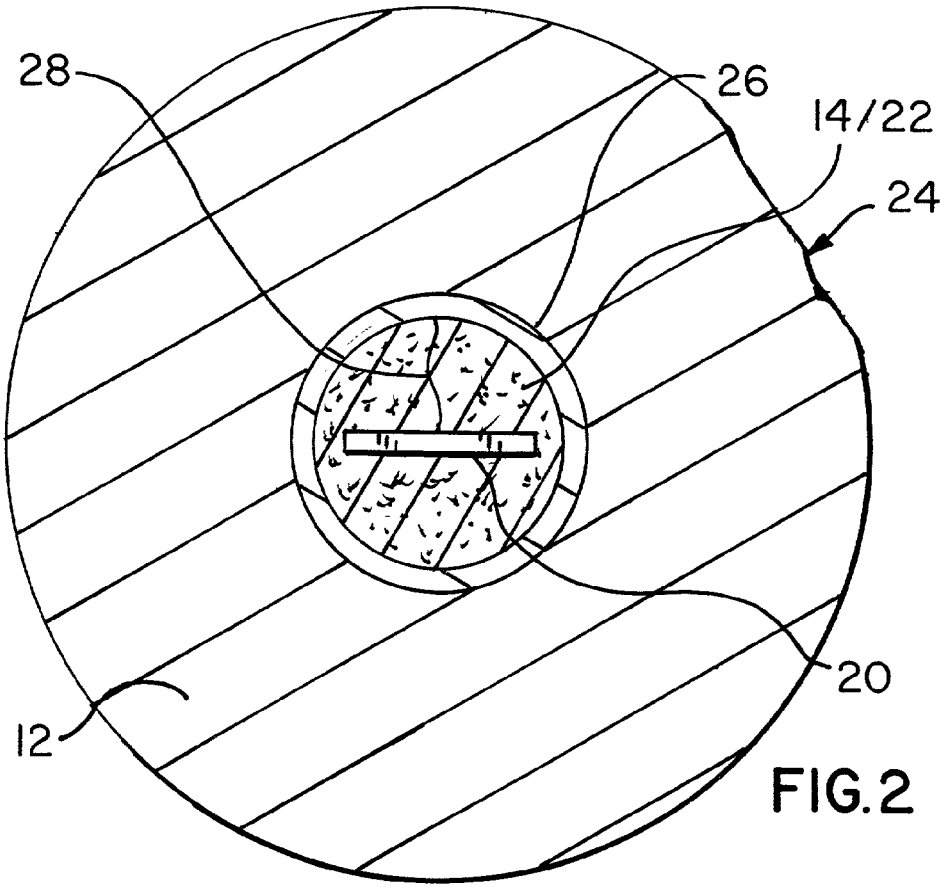
FIG. 2 is a radial cross-sectional view taken along Line 2—2 of FIG. 1, the same showing a manner of positioning of the integrated circuit board relative to the interior diameter of a central longitudinal channel of the device.
Figure 3:
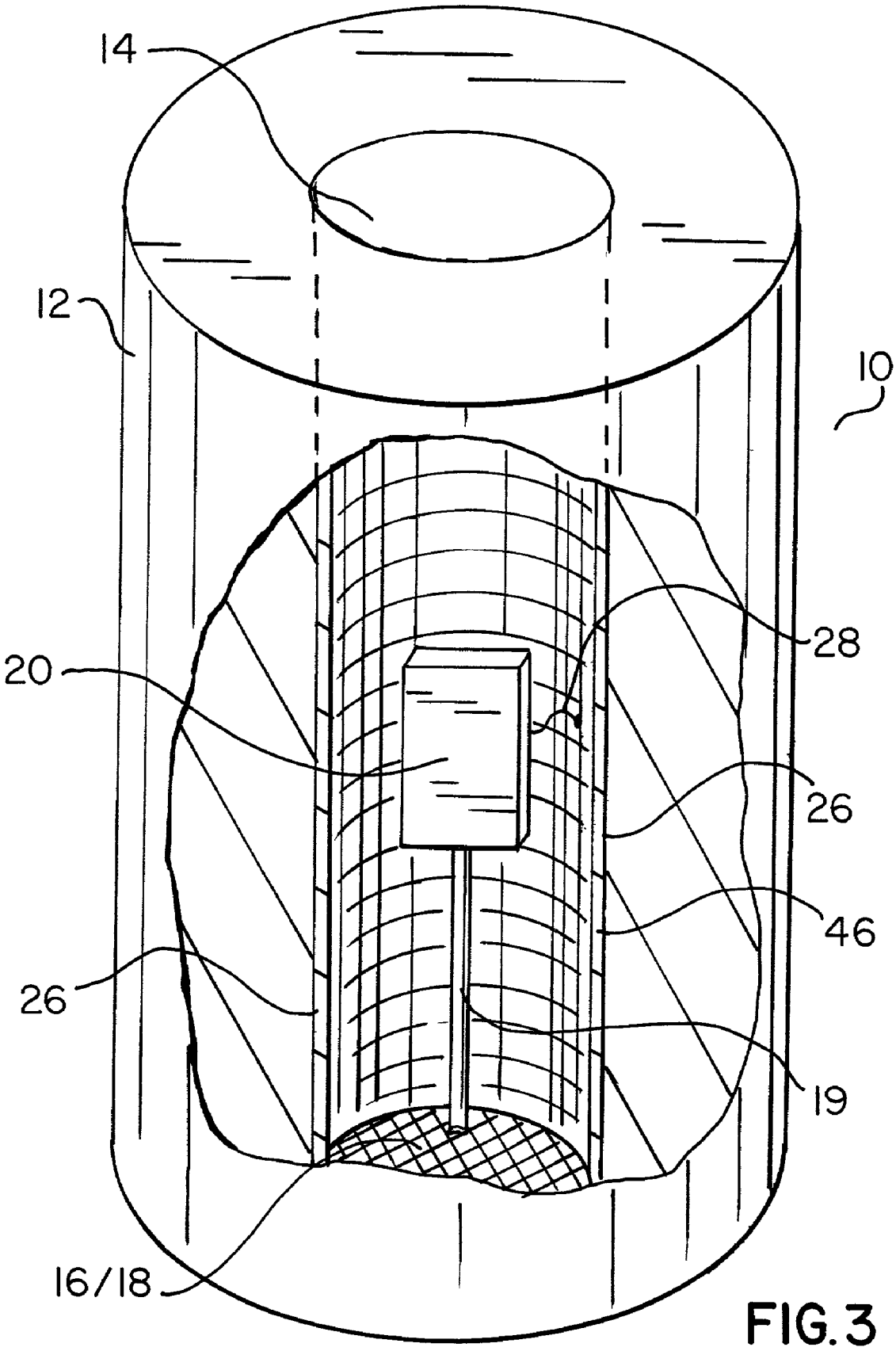
FIG. 3 is an enlarged breakaway view of FIG. 1.

In the views of FIGS. 1 to 3 are shown a piñata 10, typically having a fanciful or cylindrical structure with a length to diameter ratio of about 5 to 3. The material of a solid annular housing 12 is typically a cardboard or paper mache-like material but, as well, may be made of an appropriate thermoplastic, such as frangible polystyrene. Its actual appearance may be that of an animal or cartoon character. Axially disposed within piñata 10 is a longitudinal channel 14 having disposed at a lower end 16 thereof, an external speaker 18. Said speaker is in electrical communication with an integrated circuit (IC) board 20 which is suspended within channel 14 by compressed cotton 22, or other padding, disposed above and below IC board 20 within the channel 14.

Shock from an external force 24 as, for example, might result from the impact upon the piñata 10 by a stick or bat 25 will be communicated through said housing 12 of the piñata and, therefrom, to a shock sensor 26 which is in electrical communication with IC board 20. This is shown schematically by wire 28 in FIGS. 1 to 3. It is of course to be appreciated that a shock sensor of sufficient sensitivity may be placed directly upon the IC board, as a discrete element, this as opposed to the use of hollow cylindrical sensor 26.

Figure 4:
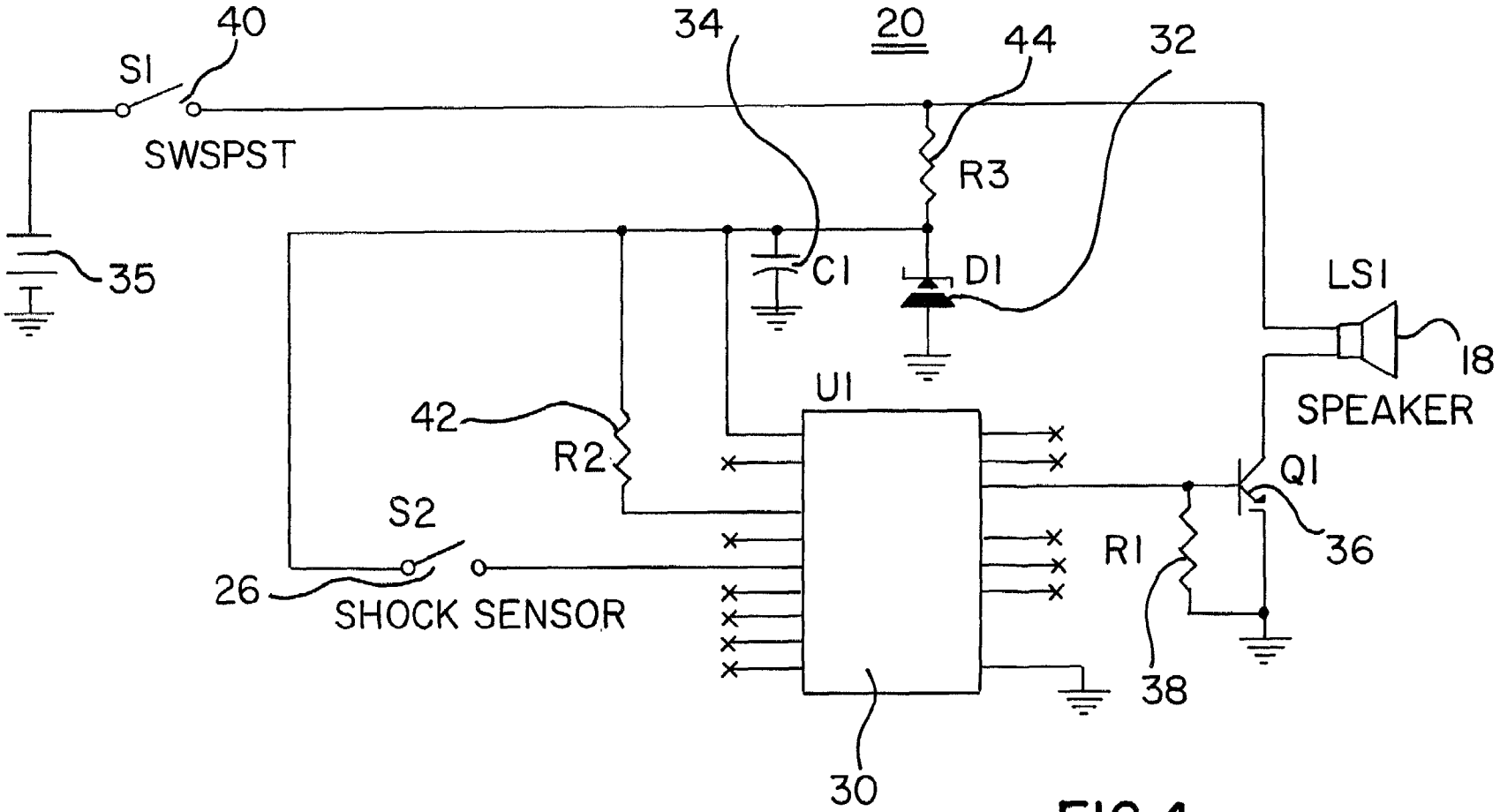
FIG. 4 is an electrical schematic of an integrated voice chip circuit board in accordance with the invention.

As may be noted in FIG. 4, the integrated circuit thereof is provided with a voice chip library 30, such as an IS22C022 chip which includes a random selection means such that each time shock sensor 26 is actuated, the voice chip library 30 will chose a different one of a plurality of pre-programmed phrases at random, and will send the same to speaker 18. Appropriate powering of the circuit is enabled through the use of a resistor 44, zener diode 32, and a filter capacitor 34. Also, appropriate current from a battery 35 to the speaker 18 is enabled through the use of transistor 36 which is biased by resistor 38. Further shown in FIG. 4 is an on-off switch 40, biasing resistor 42, and shock sensor 26.

Figure 5:
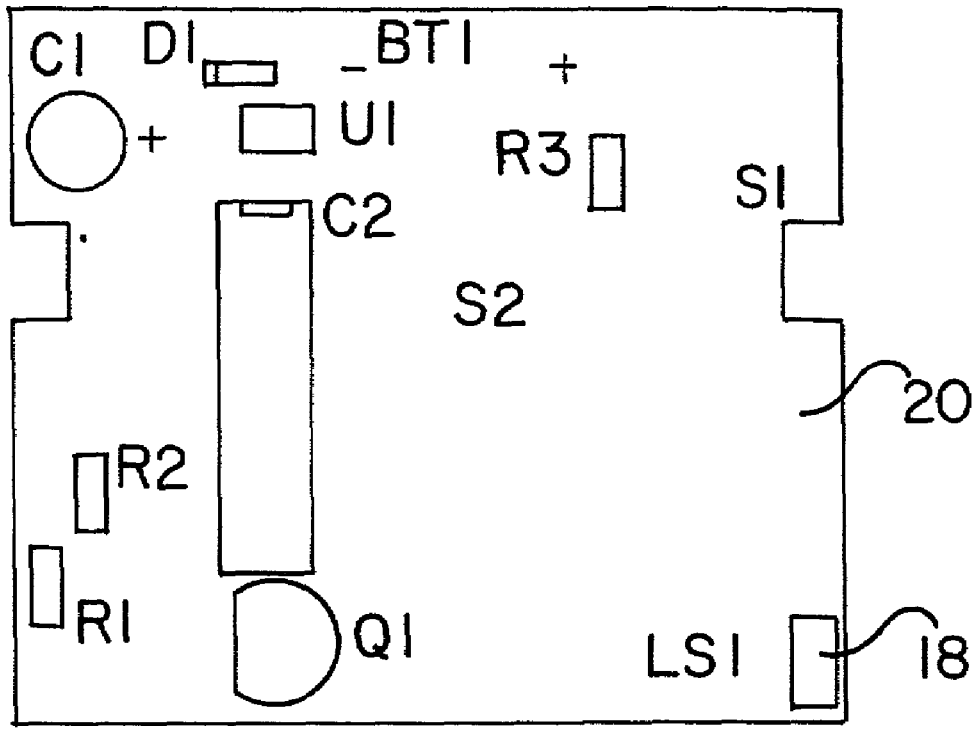
FIG. 5 is a view of the rigid substrate of the IC board of FIG. 4.

A rigid substrate of the PC board 20 is shown in FIG. 5, illustrating therein one of numerous potential configurations of the components shown in FIG. 4.

It may, thereby be appreciated that there is, through the above, provided a battery-powered talking piñata capable of broadcasting event-specific phrases responsive to a shock or impact of sufficient magnitude. Further, by housing of all components within a paper tube 46 (see FIG. 3) within channel 14 of the piñata, in combination with sufficient padding 22 thereof, the shock sensor 26 of the IC board may be employed to monitor impacts of sufficient force upon the surface of the piñata to actuate the voice chip library.

It is to be further appreciated that said paper tube 46 may, if desired, be removed from the piñata after the "breaking" thereof, for use in another piñata.

Figure 6:
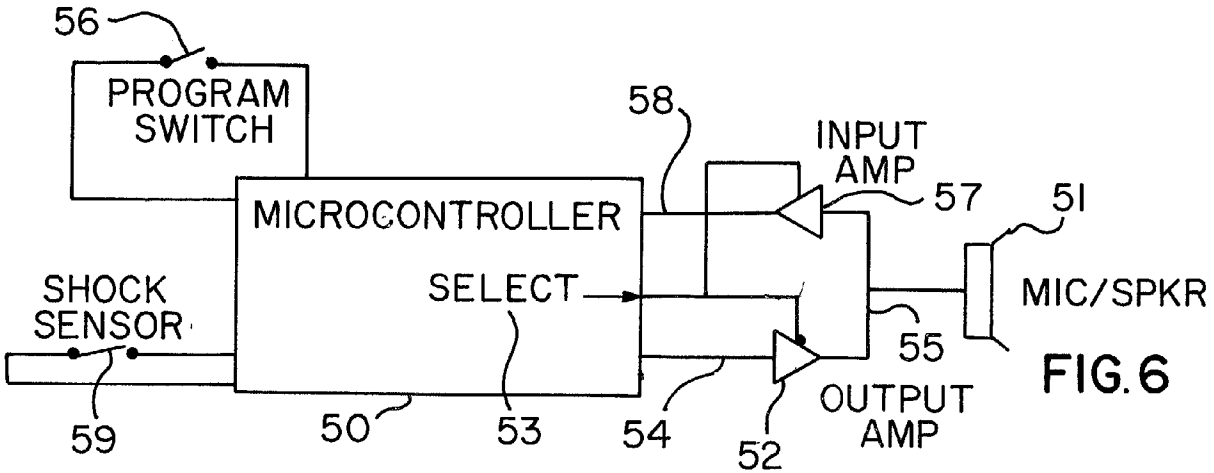
FIG. 6 is an electrical schematic of a second embodiment of the invention.

Another embodiment is shown in FIG. 6 in which a microcontroller 50 is connected to circuitry to enable sounds to be recorded for later playback. Specifically, the microcontroller 50 is attached to a mic/speaker 51 through an output amplifier 52 that is responsive to a select signal 53 from the microcontroller 50 to selectively enable output amplifier 52 to receive and amplify an audio signal 54 generated by microcontroller 50 such that an amplified audio signal 55 is applied to speaker 51. Thus, when the shock sensor 59 is disturbed by an impact of sufficient magnitude, the speaker 51 outputs sound from the piñata. This is the normal operation mode of the talking piñata.

However the piñata of this embodiment also incorporates a "record" mode which is invoked by closing program switch 56. Prior to the closing of switch 56, the microcontroller 50 is in a low-power sleep mode state. Microcontroller 50 detects the closure of switch 56, wakes up, and after a predetermined switch "debounce" and time delay inverts the polarity of the select signal 53. The select signal 53 is operative to turn off output amplifier 52, and turn on input amplifier 57.

It is well known that a speaker can be used as a microphone by application of a current through a speaker coil and detection of the change in current through the coil due to vibration of the speaker cone caused by incident sound. In the embodiment of FIG. 6, input amplifier 57 is responsive to said select signal 53 to provide the necessary bias current to mic/speaker 51. Input amplifier 57 further detects and amplifies the audio signal 55 output by mic/speaker 51 and provides an audio signal 58 to microcontroller 50. Microcontroller 50 inputs and processes audio signal 58 in a manner well known in the art, for example, by converting the analog audio signal into a digital signal. The microcontroller may optionally further process the signal by using one of a number of well known audio compression techniques, such as MP3 compression. The microcontroller 50 stores an electrical representation of the audio signal in a nonvolatile memory such as an EEPROM or flash memory that is either integral to the microcontroller or connected to the microcontroller through an interface (not shown).

While it is possible to record sound of predetermined duration, it is preferable to enable sounds of varying durations to be recorded. To this end, microcontroller 50 records sounds applied to the microphone/speaker while switch 56 is closed. The reopening of switch 56 indicates that the desired audio has been sampled. The microcontroller 50 therefore identifies and associates the electrical representation of the audio segment with a sound segment that can be played when the piñata is subjected to an impact. After recording the first sound segment, program switch 56 may again be closed to record a subsequent sound segment. This process may be repeated to record as many sound segments as the nonvolatile memory can hold.

It may be appreciated that the various components shown in FIG. 6 may be embodied in an ASIC. Also, the speaker/microphone and associated circuitry may be replaced by separate speaker and microphone elements. While the embodiment of FIG. 6 has been described in terms of digital processing of an analog signal, it is also possible to utilize analog sampling, processing and storage techniques. For example, a received audio signal may be stored using one or more analog storage elements, and compression may be achieved using analog compander circuitry. Shock sensor 59 may be replaced by a piezoelectric device to detect movement or sound.

Figure 7:
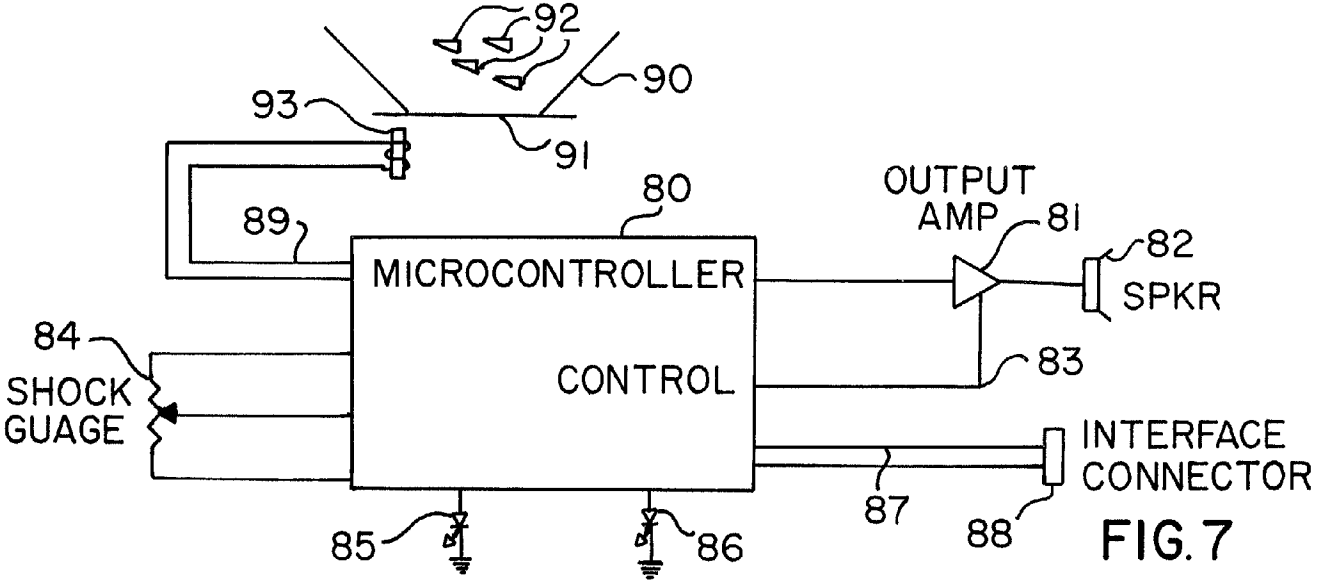
FIG. 7 is a third embodiment thereof.

In a further embodiment, shown in FIG. 7, a microcontroller 80 is connected to speaker 82 through output amplifier 81. The output amplifier 81 is responsive to control signal 83 to control the volume of the sound emanating from speaker 82. Shock gauge 84 is a sensor whose electrical characteristics vary in response to movement. For example, shock gauge 84 may comprise a strain gauge attached to a diaphragm such that when the piñata is struck, the resistance of the strain gauge changes in response to the shock impulse imparted to the diaphragm. Microcontroller 80 detects the magnitude of the shock impulse by monitoring the resistance of the strain gauge or, alternatively, the current through the strain gauge. The microcontroller 80 selects one of a plurality of predetermined audio responses to be output to the speaker 82 based upon the severity of the shock applied to the piñata. Accordingly, for example, the piñata may evoke a more antagonistic response, or a louder response when the piñata is struck a more severe blow.

As shown in FIG. 7, said embodiment may include a product dispenser 90. The product dispenser preferably consists of an opening in the piñata covered by a spring loaded dispenser door 91. Products 92, such as candy, small toys, and the like are placed within the piñata through door 91 or through an additional opening in the piñata. Following such placement, the door 91 is closed. In operation, opening of the dispenser door is effected by a solenoid 93 which is controlled by a dispense signal 89 from microcontroller 80.

Dispensing of product may be accomplished in a number of ways. For example, the microcontroller 80 may be programmed to dispense all of the product when a blow of sufficient magnitude is detected through the shock gauge 84. Alternatively, product may be dispensed after a predetermined number of hits of any magnitude are detected. This alternative would be especially desirable in instances in which those participating in the piñata celebration are very young. In addition, the dispense signal 89 may be of such a duration as to allow limited quantities of product to be dispensed each time a dispense decision is made, thereby enabling all participants to be successful in "breaking" the piñata.

LED's 85 and 86 are also controlled in response to the striking of the piñata. These LED's are preferably placed in the position of the eyes of the figure represented by the piñata, though they may also be placed elsewhere on the piñata. The LED's may be lit in accordance with the programming within the microcontroller program, or alternatively may be lit in accordance with a separate enunciator or shock sensor (not shown).

An interface connector 88 provides for programming of the piñata, and/or downloading of new features or programming into the piñata. A preferred interface is an I2C Bus interface. However any interface capable of transferring data into the piñata would be suitable. The interface enables a variety of custom or semi-custom audio segments to be downloaded into the piñata from a computer or other peripheral device. Thus, for example, a purchaser of a piñata may visit a web site and listen to a variety of alternative phrases, sounds, or voices. The purchaser may then specify a set of audio segments to be included in the piñata of his choice. Piñata parameter settings may also be selected, such as for example, the relative volume settings of selected segments, the order in which segments should be played, and the shock levels required to invoke certain responses. This information is then used to create customized download files which are downloaded into the piñata via the interface connector 88 prior to delivery of the piñata to the customer. It should be noted that the interface connector 88 may optionally comprise an acceptor for a memory element such as a ROM, EEPROM, or flash memory. In such a case, the programming information is programmed into the interface connector 88 prior to delivery of the piñata, or the piñata control device to the customer.

Programming of the piñata is advantageously limited to prevent unauthorized reprogramming of piñata hardware. Limiting reprogramming is especially important when the piñata module is reusable. This can be accomplished by embedding in the piñata's microcontroller a cryptographic signature algorithm such as RSA or DSA to ensure that downloading of new audio segments, parameters, or programming is limited to authorize distributors.

While there has been shown and described the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth herewith.

What is claimed is:

1. A sound-emitting celebration device, comprising:

(a) a fanciful housing;

(b) an impact detector in mechanical communication with said housing;

(c) a circuit within said housing in electrical communication with said impact detector, said circuit including a library of sounds, said library in electrical communication with means for actuation of different of said sounds responsive to each successive impact upon said impact detector;

(d) means for release of a prize from a compartment within said housing responsive to application of a given level of force to said impact detector;

(e) annunciation means for broadcasting an output of said sounds;

(f) cryptographic means for limiting access of potential users to said library of sounds; and (g) power means for said circuit.

2. The device as recited in claim 1, in which one or more of said sounds comprise a plurality of pre-programmed phrases.

3. The device as recited in claim 2, said circuit comprising:

means for random access actuation of different individual phrases within said library thereof.

4. The device as recited in claim 2, further comprising:

means for actuating said circuit as a function of a level of force applied to said impact detector.

5. The device as recited in claim 4, further comprising:

means for selectably downloading information to at least one of said circuits from an external input.

6. The device as recited in claim 1, in which a channel of said fanciful housing defines an internal tube.

7. The device as recited in claim 1, in which said circuit further comprises:

means for recording of external sounds and the selectable playback of a segment thereof;

said device further comprising an acoustic input device in electrical communication with at least said circuit; and means for selectable actuation of said recording means.

8. The device as recited in claim 7, in which said annunciation means includes said acoustic input device.

9. The device as recited in claim 7, in which at least one of the said circuits comprises:

means for compression of sound information stored therein.

10. The device as recited in claim 1, further comprising:

means for varying a duration of audio emission of said annunciation means.

11. The device as recited in claim 1, further comprising:

means for actuating light emitting means upon the exterior of said housing.

12. The device as recited in claim 1, further comprising:

means for selectably downloading messages to at least one of said circuits from an external digital input.

13. A sound emitting device, comprising:

(a) a fanciful housing having a channel therein;

(b) a motion sensor in mechanical communication with said housing;

(c) a circuit within said housing in electrical communication with said motion sensor, said circuit including a library of sounds, said library in electrical communication with means for actuation of a different of said sounds responsive to each successive impact upon said motion sensor sufficient to effect a given perturbation thereof;

means for releasing a prize from a compartment of said housing responsive to the application thereto of a force sufficient to produce a given perturbation;

(d) an annunciator for broadcasting at least one output of said circuit upon the actuation of said library; and (e) power means for said circuit.

14. The device as recited in claim 13, in which said motion sensor comprises:

a strain gauge in communication with diaphragm means.

15. The device as recited in claim 13, further comprising:

means for actuating specific sounds as a function of given perturbations imparted to said motion detector.

* * * * *